US006035579A

United States Patent [19]

Staser et al.

[11] Patent Number: 6,035,579

[45] Date of Patent: Mar. 14, 2000

[54] RACK AND PINION WINDOW REGULATOR

[75] Inventors: Brian Hale Staser, Troy; Jeffrey Alan Glinter, Waterford; Alfonso Pineda, Troy, all of Mich.

[73] Assignee: General Motors Corporation, Detroit, Mich.

[21] Appl. No.: 09/010,772

[22] Filed: Jan. 22, 1998

[51] Int. Cl.[7] ..... E05F 11/44

[52] U.S. Cl. ..... 49/351

[58] Field of Search ..... 49/349, 350, 351, 49/502

[56] References Cited

U.S. PATENT DOCUMENTS 1,640,864 8/1927 Ungerman ..... 49/350 X

FOREIGN PATENT DOCUMENTS 624701 7/1927 France ..... 49/351

162012 3/1933 Switzerland ..... 49/351

*Primary Examiner*—Jerry Redman

*Attorney, Agent, or Firm*—Kathryn A. Marra

[57] ABSTRACT

A window regulator has a lift arm pivoted on the door and rotatable to raise and lower a window between open and closed positions. A lever is carried by the arm and pivotally connected to a gear rack crank. A crank mechanism is provided for turning a pinion gear and the pinion gear meshes with the gear rack. Accordingly, rotation of the pinion gear translates the rack and rotates the lever to pivot the lift arm thereby raising and lowering the window. A swing arm is pivoted on the pinion shaft and carries a roller which engages the rack so that the rack is captured between the roller and the pinion gear to maintain the rack in engagement with the pinion.

4 Claims, 1 Drawing Sheet

RACK AND PINION WINDOW REGULATOR

TECHNICAL FIELD

This invention relates to a window regulator for raising and lowering a vehicle window and, more particularly, a rack and pinion arrangement connecting the crank handle and the window regulator lift arm.

BACKGROUND OF THE INVENTION

It is well known in motor vehicle doors to mount a window for movement between open and closed positions. The position of the window is controlled by a window regulator mechanism which commonly includes a lift arm having a lower end pivotally mounted on the door panel and an upper end which carries a roller sliding in a sash channel attached to the lower edge of the window glass. As the lift arm is rotated, the window glass is raised and lowered. Lift arm window regulators typically include a relatively large sector gear which is carried by the lift arm. A crank shaft operated by either a manual crank handle or an electric motor drives a pinion gear which meshes with the sector. Accordingly, rotation of the crank shaft rotates the pinion gear which in turn rotates the sector to rotate the lift arm and raise and lower the window.

In some circumstances, it is difficult to package a lift arm window regulator in the vehicle door because the gear sector carried by the lift arm is relatively large and the crank shaft needs to be located at a location on the door in which the pinion can readily mesh with the sector. Accordingly, it would be desirable to provide a new and improved mechanism for rotating the lift arm which would provide additional flexibility in packaging the mechanism within the vehicle door and provide freedom to locate the crank shaft at a wider range of chosen locations.

SUMMARY OF THE INVENTION

A window regulator has a lift arm pivoted on the door and rotatable to raise and lower a window between open and closed positions. A lever is carried by the arm and pivotally connected to a rack. A crank mechanism is provided for turning a pinion gear and the pinion gear meshes with the rack. Accordingly, rotation of the pinion gear translates the rack and rotates the lever to pivot the lift arm thereby raising and lowering the window. A swing arm is pivoted on the pinion shaft and carries a roller which engages the rack so that the rack is captured between the roller and the pinion gear to maintain the rack in engagement with the pinion.

DESCRIPTION OF THE PREFERRED EMBODIMENT

Figure 1:
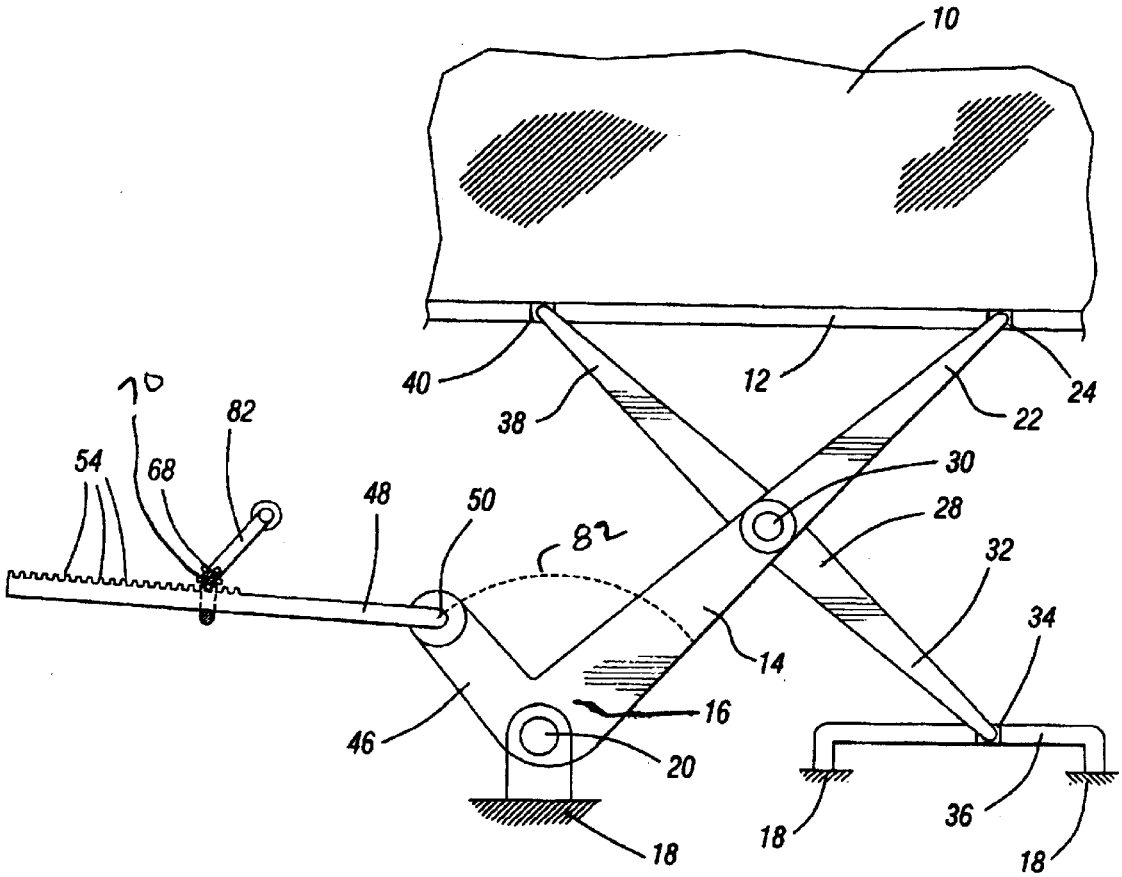
FIG. 1 is a side view showing a schematic representation of the window regulator of this invention.

Referring to FIG. 1, a window glass 10 in a vehicle door has a sash channel 12 attached along its bottom edge.

A lift arm 14 has a lower end 16 mounted on a door panel 18 by a pivot 20. The upper end 22 of lift arm 14 carries a roller or slide 24 which is captured within the sash channel 12.

The window regulator also includes a stabilizer arm 28 which is pivoted to the lift arm 14 at a pivot 30. Stabilizer arm 28 has a lower end 32 which carries a roller or slide 34 captured within a guide channel 36 mounted on the door panel 18. Stabilizer arm 28 has an upper end 38 which carries a roller or guide 40 captured in the sash channel 12.

In operation, rotation of the lift arm 14 about its pivot 20 will raise and lower the roller 24 and sash channel 12. During such movement of the lift arm 14, the pivot 30 causes the stabilizer arm 28 to follow, so that roller 40 will raise and lower the sash channel 12 while the roller 34, captured in guide channel 36, stabilizes the position of the stabilizer arm 28 .

As seen in FIG. 1, a lever arm 46 is provided integral with the lift arm 14 and extends generally laterally therefrom. A rack gear 48 has an end which is connected to the lever arm 46 by a pivot 50. The top edge of the gear rack 48 has a plurality of gear teeth 54.

Figure 2:
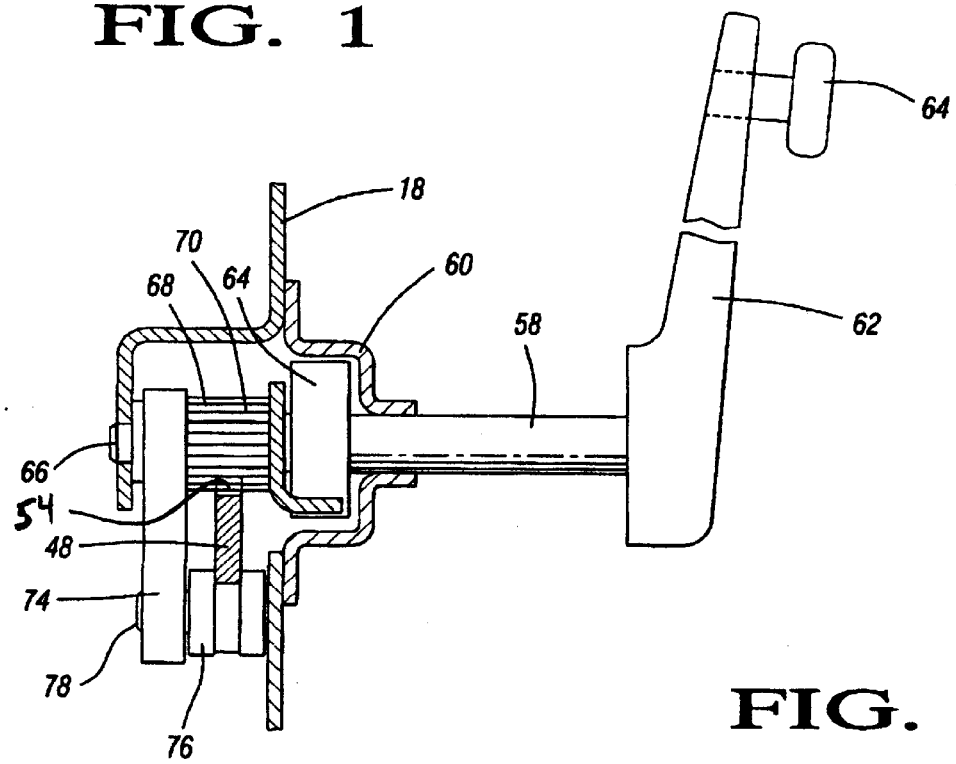
FIG. 2 is a section view taken through the crank mechanism for rotating the pinion gear.

Referring to FIG. 2, a crank mechanism is shown for operating the gear rack 48. In particular, a crank shaft 58 is rotatably mounted on a bearing bracket 60 attached to the door panel 18. A crank handle 62 is attached to the end of the crank shaft 58 and has a knob 64 by which the crank handle 62 and crankshaft 58 are rotated. A conventional window regulator clutch 64 is driven by the crank shaft 58 and, in turn, drives an output shaft 66 upon which a pinion gear 68 is mounted for rotation with the output shaft 66.

As seen in FIGS. 1 and 2, the pinion gear carries teeth 70 which mesh with the gear teeth 54 of the rack gear 48. A swing arm 74 is pivoted on the output shaft 66 and depends therefrom. A roller 76 is rotatably mounted on the lower end of the swing arm 74 by a roller shaft 78. The roller 76 engages the underside of the rack gear 48 to retain the rack gear 48 in meshing engagement with the pinion gear 68.

Referring to FIG. 1, it will be understood that rotation of the crank handle 62 will rotate the pinion gear 68 to, in turn, translate the rack gear 48 in the leftward or rightward direction as viewed in FIG. 1. This translation of the rack gear 48 will, in turn, rotate the lever arm 46 about the pivot shaft 20 to raise and lower the window regulator lift arm 14, thus raising and lowering the window.

As seen in FIG. 1, the pivot 50 at the end of the rack gear 48 will travel in an arcuate path designated 82 during operation of the window between the raised and lowered positions. It will be understood and appreciated that the swing arm 74 and roller 76 will function to permit bodily shifting movement of the rack gear 48 along the arcuate path 82 while at the same time maintaining the rack gear 48 in engagement with the pinion gear 68.

Although the drawings show the invention utilized in a cross arm window regulator having a stabilizer bar, it will be understood that the invention can also be used in a single lift arm window regulator having only a single lift arm 14. In addition, it will be understood that the rack teeth 54 could be located on the underside of the rack 48 if it were desired to reverse the direction or rotation of the crank handle 62.

Thus, it is seen that the invention provides a new and improved window regulator mechanism in which the crank handle can be located at a chosen distance and location with respect to the lift arm 14.

We claim:

1. In a vehicle window regulator having an arm pivoted on a door and rotatable to raise and lower a window between open and closed positions, the improvement comprising:

a lever attached to a pivot end of the arm at a fixed angle, a rack having an end pivoted to the lever, the rack having teeth displayed along the rack, a pinion gear engaged with the teeth of the rack, and a crank mechanism for turning the pinion gear so the rack is translated and pivots the lift arm to raise and lower the window.

2. The improvement defined in claim 1 wherein the lever is attached to the pivot end of the arm substantially at a fixed right angle.

3. In a vehicle window regulator having a lift arm pivoted on a door and rotatable to raise and lower a window between open and closed positions, the improvement comprising:

a lever attached to a pivot end of the lift arm at a fixed angle, a rack having an end pivoted to the lever, the rack having teeth displayed along the rack, a shaft mounted for rotation, a crank mechanism for rotating the shaft, a pinion gear attached to the shaft and meshing with the teeth of the rack to translate the rack upon rotation of the shaft, a swing arm having one end pivoted on the shaft and a roller carried on a second end and spaced from the pinion gear to capture the rack between the pinion gear and the roller and thereby maintain engagement between the pinion gear and the teeth on the rack.

4. The improvement as defined in claim 3 wherein the lever is attached to the pivot end of the lift arm substantially at a fixed right angle.

* * * * *